US011794246B2

(12) United States Patent
Sundström et al.

(10) Patent No.: US 11,794,246 B2
(45) Date of Patent: Oct. 24, 2023

(54) PROCESS OF MANUFACTURING AN ARTICLE COMPRISING A BODY OF A CEMENTED CARBIDE AND A BODY OF A METAL ALLOY OR OF A METAL MATRIX COMPOSITE, AND A PRODUCT MANUFACTURED THEREOF

(71) Applicant: MTC Powder Solutions AB, Surahammar (SE)

(72) Inventors: Johan Sundström, Hägersten (SE); Tomas Berglund, Falun (SE); Fredrik Meurling, Gävle (SE)

(73) Assignee: MTC Powder Solutions AB, Surahammar (SE)

( * ) Notice: Subject to any disclaimer, the term of this patent is extended or adjusted under 35 U.S.C. 154(b) by 0 days.

(21) Appl. No.: 16/613,491

(22) PCT Filed: May 24, 2018

(86) PCT No.: PCT/EP2018/063686
§ 371 (c)(1),
(2) Date: Nov. 14, 2019

(87) PCT Pub. No.: WO2018/215608
PCT Pub. Date: Nov. 29, 2018

(65) Prior Publication Data

US 2020/0164440 A1 May 28, 2020

(30) Foreign Application Priority Data

May 24, 2017 (EP) ..... 17172708

(51) Int. Cl.
*B22F 3/15* (2006.01)
*B22F 7/00* (2006.01)
(Continued)

(52) U.S. Cl.
CPC ..... *B22F 3/15* (2013.01); *B22F 7/008* (2013.01); *B22F 7/064* (2013.01);
(Continued)

(58) Field of Classification Search
CPC .. B22F 3/15; B22F 7/008; B22F 7/064; B22F 2007/042; B22F 2301/10; B22F 2301/35;
(Continued)

(56) References Cited

U.S. PATENT DOCUMENTS 5,904,966 A * 5/1999 Lippens ..... H01F 41/18 428/677
2012/0003493 A1 1/2012 Schon et al.

FOREIGN PATENT DOCUMENTS

EP 0 090 657 A2 10/1983
JP 2000-042756 A 2/2000
(Continued)

OTHER PUBLICATIONS

Translation of JP 2009131917 (Year: 2009).*
(Continued)

*Primary Examiner* — Brian D Walck
*Assistant Examiner* — Danielle Carda
(74) *Attorney, Agent, or Firm* — Morgan, Lewis & Bockius LLP

(57) ABSTRACT

The present disclosure relates to a process of manufacturing an article comprising at least one body of a cemented carbide and at least one body of a metal alloy or at least one body of a metal matrix composite and to a product manufactured thereof and wherein the article also comprises an interlayer between the at least one body of a cemented carbide and at least one body of a metal alloy or at least one body of a metal matrix composite in order to prevent deleterious interface phases from forming.

14 Claims, 3 Drawing Sheets

(51) Int. Cl.
*B22F 7/06* (2006.01)
*B22F 7/04* (2006.01)

(52) U.S. Cl.
CPC ..... *B22F 2007/042* (2013.01); *B22F 2301/10* (2013.01); *B22F 2301/35* (2013.01); *B22F 2302/10* (2013.01)

(58) Field of Classification Search
CPC .... B22F 2302/10; B22F 2998/10; B22F 7/08; C22C 29/08; C22C 29/10; C22C 29/02
USPC ..... 419/49
See application file for complete search history.

(56) References Cited

FOREIGN PATENT DOCUMENTS

| | | |
|---|---|---|
| JP | 2009-131917 A | 6/2009 |
| WO | 2016/184956 A1 | 11/2016 |

OTHER PUBLICATIONS

Encyclopaedia Britannica, Monel, Published Nov. 19, 2007 (Year: 2007).*
Bell, Terence, What is Cupronickel, Thought Co. Updated May 12, 2018 (Year: 2018).*
Nickel Institute, Mechanical properties of copper-nickel alloys, 2022 (Year: 2022).*
CAS, tungsten carbide with cobalt binder, Jan. 12, 2022 (Year: 2022).*
CLM Fireproofing, Understanding the ire Resistance of Structural Steel, Passive Fire Protection 2020 (Year: 2020).*
International Search Report and Written Opinion dated Aug. 20, 2018, issued in corresponding International Patent Application No. PCT/EP2018/063686.

* cited by examiner

PROCESS OF MANUFACTURING AN ARTICLE COMPRISING A BODY OF A CEMENTED CARBIDE AND A BODY OF A METAL ALLOY OR OF A METAL MATRIX COMPOSITE, AND A PRODUCT MANUFACTURED THEREOF

TECHNICAL FIELD

The present disclosure relates to a hot isostatic pressing (HIP) process of manufacturing a hot isostatic pressed article comprising at least one body of a cemented carbide and at least one body of a metal alloy or of a metal matrix composite (MMC) and to an article manufactured by the process.

BACKGROUND

Hot Isostatic Pressing (HIP) of metal or ceramic powders or combinations thereof is a method which is very suitable for Near Net Shape manufacturing of individual components. In HIP, a capsule which defines the final shape of the component is filled with a metallic powder and subjected to high temperature and pressure whereby the particles of the metallic powder bond metallurgically, voids are closed and the material is consolidated. The main advantage of the method is that it produces components of final, or close to final, shape having strengths comparable to or better than forged material. To increase the wear resistance of components manufactured by HIP, attempts have been made to integrate cemented carbides bodies in components made of steel or cast iron. Cemented carbide bodies consist of a large portion hard particles and a small portion of binder phase and are thus very resistant to wear.

However, due to formation of brittle phases such as $M_6C$-phase (a.k.a. eta-phase) and $W_2C$-phase in the interface between the cemented carbide body and the surrounding steel or cast iron, these attempts have not been successful. The brittle phases crack easily under load and may cause detachment of the cemented carbide or the cracks may propagate into the cemented carbide bodies and cause these to fail with decreased wear resistance of the component as a result.

There have been attempts to solve this problem, by for example prior art as disclosed by US 2012/0003493A1 which describes a method of providing a composite product comprising a cemented carbide body attached to a metal carrier body, wherein said bodies are attached to each other by means of a HIP process and a nickel interlayer is positioned between the two bodies to be joined. The nickel interlayer is said to prevent carbon from migrating from the cemented carbide body to the metal body, and thereby also prevent the upcoming of said brittle phases. However, at higher temperature, i.e. above 1050° C., and in particular above 1100° C., and for several carbide grades and long process times, it has been shown that nickel does not provide sufficient diffusion barrier properties to prevent the formation of the above mentioned deleterious phases. US 2012/0003493A1 suggests copper as a possible interlayer when joining two metals by means of a possible interlayer. However, copper has a relatively low melting point (1085° C.) and during the HIP process, usually performed around 1150° C., a copper interlayer will melt during the process and therefore the effect of the interlayer will be lowered and the layer may not be intact.

It is therefore an aspect of the present disclosure to provide a method which remedies at least one of the above-mentioned drawbacks of prior art. In particular, it is an object of the present disclosure to provide a process that allows for manufacturing of articles having high wear resistance. A further object of the present disclosure is to provide a process allowing the manufacturing of wear resistant articles in which cemented carbide bodies are securely retained with no or very little formation of brittle phases. Yet a further object of the present disclosure is to provide a process which allows for cost effective manufacturing of wear resistant articles.

SUMMARY

The present disclosure therefore relates to a hot isostatic pressing process for manufacturing an article comprising at least one body of a cemented carbide and at least one body of a metal alloy or of a metal matrix composite, comprising the steps of:

a) providing at least one body of a metal alloy or a metal matrix composite and at least one body of a cemented carbide;

b) positioning a metallic interlayer between a surface of the at least one body of a cemented carbide and a surface of the at least one body of a metal alloy or of a metal matrix composite; or positioning a metallic interlayer on at least one surface of the at least one body of a metal alloy or of the at least one body of a metal matrix composite or of the at least one body of a cemented carbide;

c) enclosing a portion of the at least one body of a metal alloy or the at least one body of a metal matrix composite and the metallic interlayer and the least one body of a cemented carbide in a capsule or enclosing the at least one body of a metal alloy or the at least one body of a metal matrix composite and the metallic interlayer and the at least one body of a cemented carbide in a capsule;

d) optionally evacuating air from the capsule;

e) sealing the capsule;

f) subjecting a unit comprised by the capsule, a portion of the at least one body of a metal alloy or the at least one body of a metal matrix composite and the metallic interlayer and the least one body of a cemented carbide or subjecting a unit comprised by the capsule, the at least one body of a metal alloy or the at least one body of a metal matrix composite and the metallic interlayer and the at least one body of a cemented carbide to a predetermined temperature of above about 1000° C. and a predetermined pressure of from about 300 to about 1500 bar during a predetermined time;

wherein the metallic interlayer is formed by an alloy essentially consisting of copper and nickel.

There will be a difference in carbon activity between the metal body or the metal matrix composite and the body containing cemented carbide, as the body comprising cemented carbide will have higher carbon activity. This difference will generate a driving force for migration of carbon from the cemented carbide to the metal. However, experiments have surprisingly shown that by having a metallic interlayer comprising an alloy essentially consisting of copper and nickel between or on at least one surface of the bodies or on the surface of the portion of the bodies to be HIP:ed, the above-mentioned problems are alleviated. The experiments have shown that the metallic interlayer will make carbon diffusion between the bodies low, without being bound to any theory, it is believed that this is due to the low solubility for carbon in the metallic interlayer at the processing temperatures in question. The metallic interlayer will thus be acting as a migration barrier or a choke for the migration of carbon atoms between the at least one body of metal alloy or of metal matrix alloy and the at least on body of the cemented carbide without impairing the ductility of the diffusion bond between the bodies. Furthermore, because of this migration barrier, the strength of the bond will be high as no deleterious interface phases, for example eta phase, or very low amounts of deleterious interface phases, such as eta phase will be formed, deleterious interface phases are known to have a negative impact on the strength of a diffusion bond.

Another advantage of the present process is that it will provide for the tailoring of the mechanical properties for the article by allowing for specifically selecting the specific materials for the bodies.

The present disclosure also relates to a hot isostatic pressed article comprising;

at least one body of a cemented carbide;

at least one body of a metal alloy or a metal matrix composite, wherein the at least one body of cemented carbide and the at least one body of metal alloy or the at least one body of metal matrix composite are diffusion bonded by a metallic interlayer comprising an alloy essentially consisting of copper (Cu) and nickel (Ni).

DETAILED DESCRIPTION

Figure 2A:
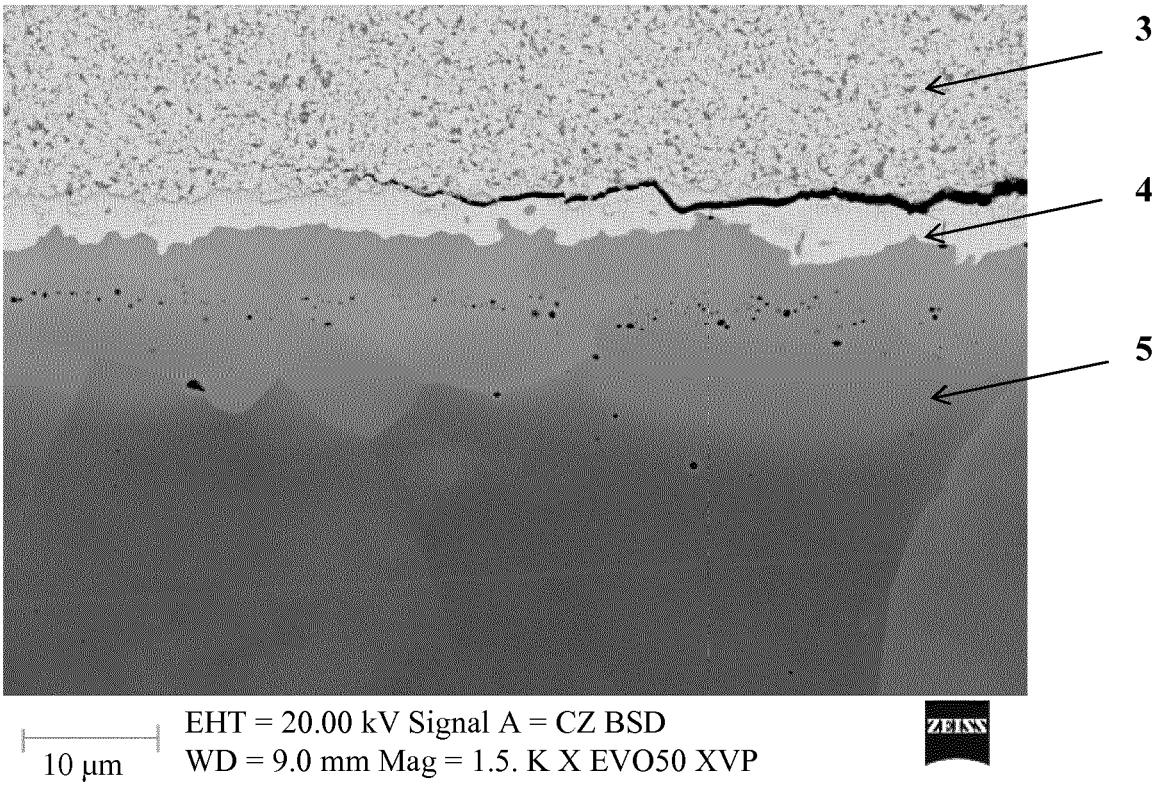
FIG. 2A shows a SEM picture of an article containing a metallic interlayer of Ni, wherein the interface between the metallic interlayer and the cemented carbide is shown.
Figure 2B:
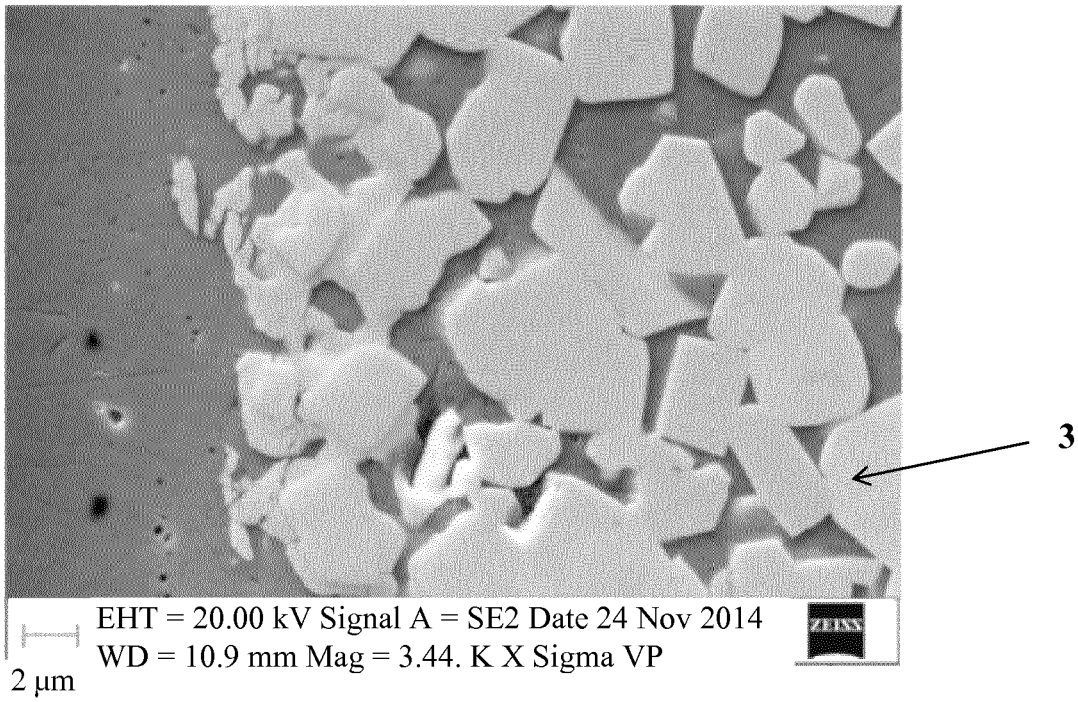
FIG. 2B shows a SEM picture of an article containing a metallic interlayer of Ni, wherein an enlargement of the interface between the metallic interlayer and the body of the cemented carbide is shown.
Figure 3:
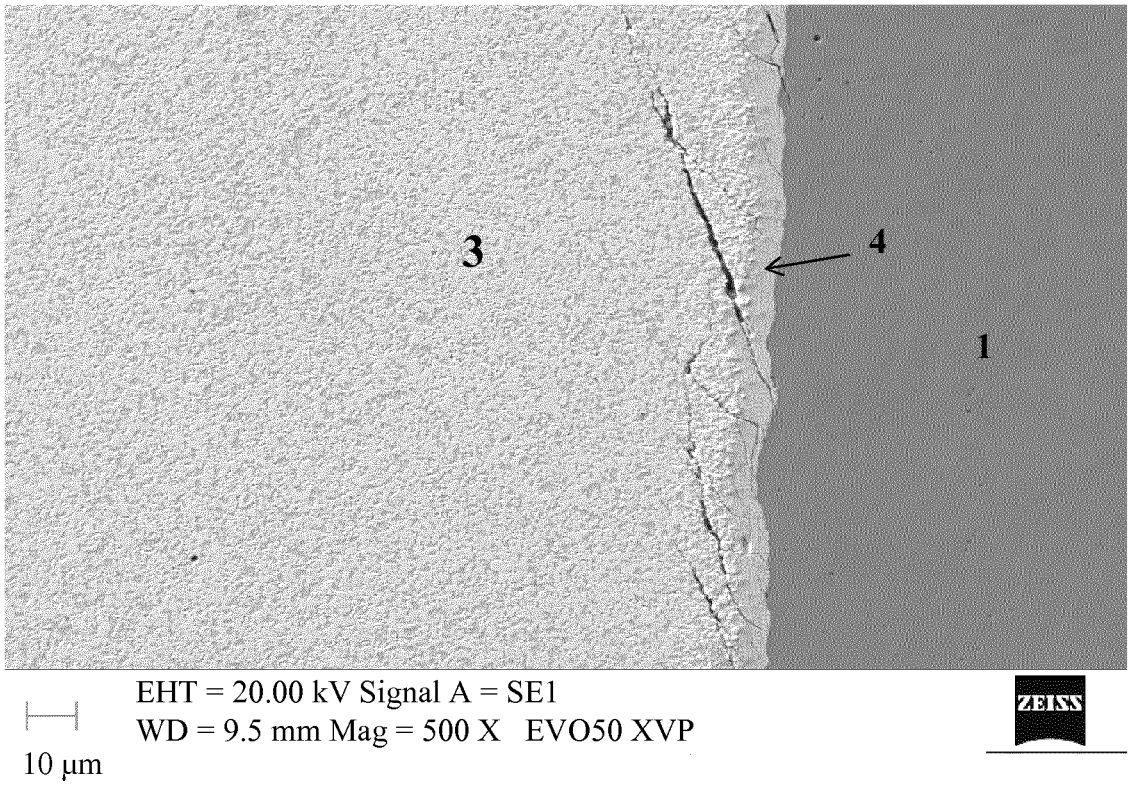
FIG. 3 shows a SEM picture of an article containing no metallic interlayer wherein the interface between the metal body and cemented carbide body is shown.

The present disclosure relates to a hot isostatic pressing process for manufacturing an article comprising at least one body of a cemented carbide and at least one body of a metal alloy or of a metal matrix composite, comprising the steps of:

a) providing at least one body of a metal alloy or a metal matrix composite and at least one body of a cemented carbide;

b) positioning a metallic interlayer between a surface of the at least one body of a cemented carbide and a surface of the at least one body of a metal alloy or of a metal matrix composite or positioning a metallic interlayer on at least one surface of the at least one body of a metal alloy or of the at least one body of a metal matrix composite or of the at least one body of a cemented carbide;

c) enclosing a portion of the at least one body of a metal alloy or the at least one body of a metal matrix composite and the metallic interlayer and the least one body of a cemented carbide in a capsule or enclosing the at least one body of a metal alloy or the at least one body of a metal matrix composite and the metallic interlayer and the at least one body of a cemented carbide in a capsule;

d) optionally evacuating air from the capsule;

e) sealing the capsule;

f) subjecting a unit comprised by the capsule, a portion of the at least one body of a metal alloy or the at least one body of a metal matrix composite and the metallic interlayer and the least one body of a cemented carbide or subjecting a unit comprised by the capsule, the at least one body of a metal alloy or the at least one body of a metal matrix composite and the metallic interlayer and the at least one body of a cemented carbide to a predetermined temperature of above about 1000º C. and a predetermined pressure of from about 300 to about 1500 bar during a predetermined time; wherein the metallic interlayer is formed by an alloy essentially consisting of copper and nickel. During the process, the different bodies and the metallic interlayer will by diffusion bonding become one article. By using the metallic interlayer as defined hereinabove or hereinafter, the diffusion of carbon will be limited/reduced and thereby the formation of detrimental phases, e.g. eta-phase, in the interface of the bodies is avoided or reduced. As can be seen from FIG. 1A, which shows a SEM image of the interface between a body of a cemented carbide (3) and a body of a metal alloy (1) and the interlayer having a metallic interlayer (2) consisting essentially of Cu and Ni. As can be seen from the FIG. 1A, no eta phases (4) have been formed to be compared with FIG. 2A which shows the interface of a Ni interlayer (5) and a cemented carbide (3) and FIG. 3 which shows the interface of a steel body (1) and cemented carbide (3) without an interlayer. Furthermore, the present process will provide for that there will be no dissolution of the tungsten carbide in the body of cemented carbide (see FIG. 1B) to be compared with FIG. 2B and FIG. 3 which both show that the cemented carbide is dissolved in the interface and forms a continuous phase. In the present disclosure, the term "surface" is intended to mean the contact surface, i.e. the surfaces to be bonded/joined, on the at least one body of hard metal which is intended to form a diffusion bond with the at least one body of metal or MMC through the metallic interlayer and vice versa. At least a part of the contact surface has to be covered with the metallic interlayer.

A metal matrix composite (MMC) is a composite material comprising at least two constituent parts, one part being a metal and the other part being a different metal or another material, such as a ceramic, carbide, or other types of inorganic compounds, which will form the reinforcing part of the MMC. According to one embodiment of the present process as defined hereinabove or hereinafter, the at least one metal matrix composite body (MMC) consists of hard phase particles selected from carbides, such as titanium carbide, tantalum carbide and/or tungsten carbide, but also from oxides, nitrides and/or borides and of a metallic binder phase which is selected from cobalt, nickel and/or iron. According to yet another embodiment, the at least one body of MMC comprising essentially of hard phase particles of tungsten carbide and a metallic binder of cobalt or nickel or iron or a mixture thereof.

A cemented carbide is an example of a metal matrix composite and comprise carbide particles in a metallic binder. Typically, more than 50 wt % of the carbide particles in the cemented carbide are tungsten carbide (WC), such as 75 to 99 wt %. Other particles may be TiC, TiN, Ti(C,N), NbC and/or TaC. According to one embodiment, the at least one body of cemented carbide consists of hard phase comprising titanium carbide, tantalum carbide and tungsten carbide and a metallic binder phase selected from cobalt, nickel and/or iron. According to one embodiment, the at least one body of cemented carbide body consists of a hard phase comprising more than 75 wt % tungsten carbide and a binder metallic phase of cobalt. The at least one body of cemented carbide may be either pre-sintered powder or a sintered body. The at least one body of cemented carbide may also be a powder. The at least one body of cemented carbide may be manufactured by molding a powder mixture of hard phase and metallic binder and then pressing the powder mixture into a green body. The green body may then be sintered or pre-sintered into a body which is to be used in the present process.

The capsule may be a metal capsule which may be sealed by means of welding. The encapsulation is either performed on a portion of the at least one body of a metal alloy or a metal matrix composite and the metallic interlayer and the least one body of a cemented carbide or on the at least one body of a metal alloy or of a metal matrix composite and the metallic interlayer and the at least one body of a cemented carbide. It is to be understood that the capsule is at least enclosing the joint between the least one body of a cemented carbide and the at least one body of a metal alloy or of a metal matrix composite and the metallic interlayer.

The terms "diffusion bond" or "diffusion bonding" as used herein refers to as a bond obtained through a diffusion bonding process which is a solid-state process capable of bonding similar and dissimilar materials. It operates on the principle of solid-state diffusion, wherein the atoms of two solid, material surfaces intermingle over time under elevated temperature and elevated pressure.

According to the present process, the metallic interlayer may be formed from a foil or a powder. However, the application of the metallic interlayer may also be performed by other processes such as thermal spray processes (HVOF, plasma spraying and cold spraying). The metallic interlayer may be applied to either of the surfaces of the at least body of the metal alloy or MMC and the at least one body of hard metal or on both surfaces of the bodies or in between the bodies. For the parts to be HIP:ed, it is important that there are no areas where the at least one body of cemented carbide is in direct contact with the at least one body of metal alloy or the MMC. The metallic interlayer may also be applied by electrolytic plating. The metallic interlayer will thus form two interfaces, one together with the at least one portion or with the at least one body of metal alloy or of the MMC. The other interface is together with the at least one body or the portion of the cemented carbide.

According to the present disclosure, the copper content of the metallic interlayer is of from 20 to 98 weight % (wt %). According to another embodiment, the Cu content is of from 25 to 98 wt %, such as from 30 to 90 weight % (wt %), such as 35 to 90, such as of from 50 to 90 wt %. The chosen composition of the metallic interlayer will depend on several parameters, such as the HIP cycle plateau temperature and holding time as well as the carbon activity in the materials to be diffusion bonded at the temperature where the bodies are to be bonded article. According to one embodiment, the metallic interlayer has a thickness of about 50 to about 500 μm, such as of from 100 to 500 μm. The term "essentially consists" as used herein refers to that the metallic interlayer apart from copper and nickel also may comprise other alloying elements, though only at impurity levels, i.e. less than 3 wt %. Examples of other alloying elements are Manganese and Iron.

The bodies may be in the form of powders, loosely bound powders or as solid bodies. Additionally, according to one embodiment of the present process, the at least one body of cemented carbide is a more than or equal to two. Additionally, according to another embodiment, the at least one body of metal alloy or the at least one body of metal matrix composite is more than or equal to two. According to one embodiment, at least one recess may be created in the at least one body of metal alloy or in the at least one body of metal matrix alloy, said least one recess may have the same form or a similar form as the at least one body of cemented carbide. The interlayer is first placed in the least one recess and then the at least one cemented carbide is placed therein.

In the present HIP process, the diffusion bonding of the at least one body or portion of the cemented carbide to the at least one body or portion of the metal alloy or body of the metal matrix composite and the metallic interlayer occurs when the capsule is exposed to the high temperature and high pressure for certain duration of time inside a pressure vessel. The high temperature, is a temperature which is below the melting temperature for all the articles. During this HIP treatment, the bodies/portions and metallic interlayer are consolidated and diffusion bonds are formed. As the holding time comes to an end, the temperature inside the vessel and consequently also of the consolidate article is returned to room temperature and atmospheric pressure. After cooling of the above-mentioned unit and optional removal of the capsule, the obtained article comprising diffusion bonded bodies will define a hot isostatic pressed article comprising at least one body of a cemented carbide and at least one body of a metal alloy or of a metal matrix composite, wherein said bodies are joined by diffusion bonds, and wherein said diffusion bonds are formed by the elements of the interlayer and of the elements of the bodies and wherein said metallic interlayer comprises an alloy essentially consisting of copper and nickel.

The pre-determined temperature applied during the predetermined time may, of course, vary slightly during said period, either because of intentional control thereof or due to unintentional variation. The temperature should be high enough to guarantee a sufficient degree of diffusion bonding within a reasonable period of time between the bodies. According to the present process, the predetermined temperature is above about 1000° C., such as about 1100 to about 1200° C.

The predetermined pressure applied during said predetermined time may vary either as a result of intentional control thereof or as a result of unintentional variations thereof related to the process. The predetermined pressure will depend on the properties of the bodies to be diffusion bonded.

The time during which the elevated temperature and the elevated pressure are applied will, of course, depend on the rate of diffusion bonding achieved with the selected temperature and pressure for a specific body geometry, and also, of course, on the properties of the bodies to be diffusion bonded. Example of predetermined time ranges of from 30 minutes to 10 hours.

According to one embodiment of the process as defined hereinabove or hereinafter, the at least one body of a metal alloy is a body of a steel alloy. The steel grade may be selected depending on functional requirement of the product to be produced. For example, the steel may be a tool steel such as AISI O1. Other examples are, but not limited to, stainless steel, carbon steel, ferritic steel, austenitic steel and martensitic steel. The at least one body of a metal alloy may be a forged and/or a cast body or a HIP:ed body.

Examples but not limited thereto of an article of the present disclosure are a crusher part, a valve part, a roll and a nozzle.

The use of the terms "a" and "an" and "the" and similar referents in the context of describing the disclosure (especially in the context of the following claims) are to be construed to cover both the singular and the plural, unless otherwise indicated herein or clearly contradicted by context. With the expression "about" is herein meant ±10% of the indicated value.

The present disclosure is further illustrated by the following non-limiting examples.

EXAMPLES

Cylindrical solid rods with flat perpendicular end surfaces and Ø19 mm diameter were butt-joined using two different processes; HIP diffusion joining and induction brazing. The two materials were AISI O1 steel and a fine-grained (0.8 μm WC grain size) cemented carbide with roughly 10% cobalt binder phase.

The induction brazing used a two-phase solder of chemical compositions roughly according to table 1 and the solder bond thickness was roughly 80-110 μm.

TABLE 1

Chemical composition of the two phases in the solder used in the brazing trials.

| Solder phase | Ag | Cd | Cu | Zn | Ni |
|---|---|---|---|---|---|
| Light grey* | 67 | 22 | 4 | 7 | — |
| Dark grey* | 3 | — | 44 | 33 | 20 |

Figure 1A:
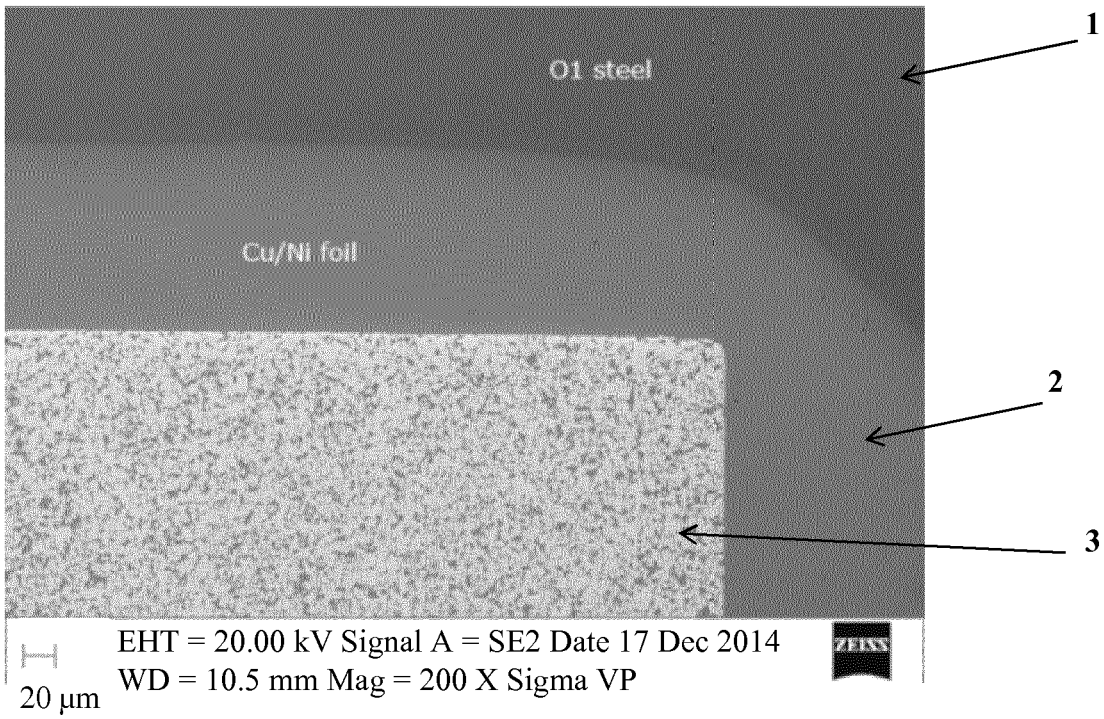
FIG. 1A shows a SEM picture of an article obtained from the present process—the interface between the body of the metal alloy, the metallic interlayer (Cu/Ni) and the body of the cemented carbide is shown.
Figure 1B:
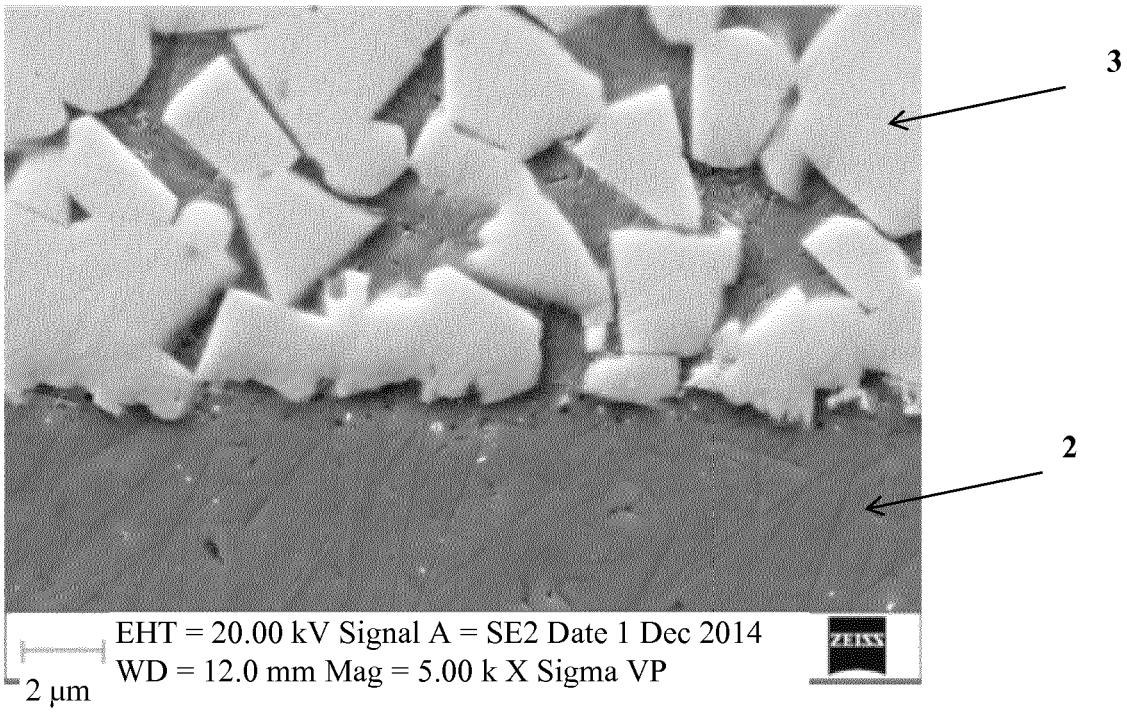
FIG. 1B shows a SEM picture of an article obtained from the present process, wherein an enlargement of the interface between the metallic interlayer (Cu/Ni) and the body of the cemented carbide is shown.

In the HIPed counterpart, an interlayer of 200 μm Ni—Cu foil was used having a chemical composition of roughly 45% Ni, 1% Mn, 0.2% Fe and the remainder Cu (weight-%). A cylindrical tube with closed ends was used as the HIP capsule. The air was evacuated from the capsule prior to it being welded shut and placed in the HIP chamber. The HIP-cycle plateau was characterized by a 3 hour holding time at 1150° C. and 100 MPa pressure. SEM images of polished sections of the HIP articles are shown in FIGS. 1A and 1B.

From these two types of bonded articles, cylindrical rod blanks of length 80 mm and diameter Ø6.7 mm were extracted using wire EDM. The bond was positioned at midlength. The blanks were circumferentially ground using a centerless circular grinding machine down to a diameter of Ø6.3 mm and a surface finish of roughly Ra=0.5 μm. These rods were then manually polished circumferentially with diamond paste down to a surface finish of roughly Ra=0.5 μm. These polished specimens were then exposed to four-point-bend-testing in a rig with the four cylindrical transverse supports (relative to the orientation of the specimens) equally spaced with 20 mm and a force was applied to the two central supports. The maximum force applied just prior to fracture for the two types of bonded specimens are given in Table A.

TABLE A

Results of four-point bend tests. Max force applied prior to fracture.

| Bond type | 1 | 2 | 3 | 4 |
|---|---|---|---|---|
| Brazed | 1.2 kN | 1.0 kN | 1.0 kN | 1.0 kN |
| HIPed | 4.3 kN | 4.0 kN | | |

These results show that the HIP induction bonding process using a copper-nickel interlayer results in a stronger bond than ordinary induction brazing.

The invention claimed is:

1. A hot isostatic pressing process for manufacturing an article comprising at least one body of a cemented carbide and at least one body of a metal alloy or of a metal matrix composite, comprising the steps of:

a) providing at least one body of a metal alloy or a metal matrix composite and at least one body of a cemented carbide;

b) positioning a metallic interlayer between a surface of the at least one body of a cemented carbide and a surface of the at least one body of a metal alloy or of a metal matrix composite or positioning a metallic interlayer on at least one surface of the at least one body of a metal alloy or of the at least one body of a metal matrix composite or of the at least one body of a cemented carbide;

c) enclosing a portion of the at least one body of a metal alloy or the at least one body of a metal matrix composite and the metallic interlayer and the at least one body of a cemented carbide in a capsule or enclosing the at least one body of a metal alloy with the metallic interlayer on at least one surface or the at least one body of a metal matrix composite with the metallic interlayer on at least one surface or the at least one body of a cemented carbide with the metallic interlayer on at least one surface in a capsule;

d) optionally evacuating air from the capsule;

e) sealing the capsule; and f) subjecting a unit to a solid state diffusion process, wherein the unit comprises the capsule, a portion of the at least one body of a metal alloy or the at least one body of a metal matrix composite and the metallic interlayer and the least one body of a cemented carbide or comprises the capsule, the at least one body of a metal alloy or the at least one body of a metal matrix composite with the metallic interlayer on at least one surface or the at least one body of a cemented carbide with the metallic interlayer on at least one surface, wherein the solid state diffusion process exposes the unit to a predetermined temperature of above about 1100° C. and below a melting temperature of the metallic interlayer and a predetermined pressure of from about 300 to about 1500 bar during a predetermined time, wherein the metallic interlayer is formed by an alloy having a composition consisting essentially of copper, nickel, and less than 3 wt % total other elements, where each other element is at an impurity level, wherein the composition of the alloy of the metallic interlayer has a copper content from 20 to 98 wt %, and wherein the metallic interlayer has a thickness of from about 50 to 500 μm.

2. The process according to claim 1, wherein the copper content is from 30 to 90 wt %.

3. The process according to claim 1, wherein the metallic interlayer is formed by a foil or a powder.

4. The process according to claim 1, wherein the predetermined temperature is from about 1100 to about 1200° C.

5. The process according to claim 1, wherein the at least one cemented carbide body consists of a hard phase comprising one or more of titanium carbide, tantalum carbide, and tungsten carbide, or a mixture thereof and a metallic binder phase selected from cobalt, nickel and iron or a mixture thereof.

6. The process according to claim 1, wherein the at least one metal alloy body is a steel body.

7. The process according to claim 1, wherein the metallic interlayer is formed by electrolytic plating.

8. The process according to claim 1, wherein the article comprises more than or equal to two cemented carbide bodies.

9. The process according to claim 1, wherein the copper content is from 50 to 90 wt %.

10. The process according to claim 1, wherein the predetermined temperature is also below a melting temperature of the at least one body of the unit.

11. The process according to claim 1, wherein (i) the portion of the at least one body of the metal alloy or the at least one body of the metal matrix composite and the metallic interlayer and the least one body of the cemented carbide or (ii) the at least one body of the metal alloy or the at least one body of the metal matrix composite with the metallic interlayer on at least one surface or the at least one body of the cemented carbide with the metallic interlayer on at least one surface define components of the unit, and wherein the predetermined temperature is below a melting temperature of the components of the unit.

12. The process according to claim 1, wherein the predetermined time is from 30 minutes to 10 hours.

13. The process according to claim 1, further comprising:

after step (f), cooling the unit and optional removing the capsule, wherein the article includes the at least one body of the cemented carbide and the at least one body of the metal alloy or of the metal matrix composite joined by diffusion bonds, and wherein the diffusion bonds are formed by elements of the metallic interlayer and of elements of the bodies.

14. The process according to claim 13, wherein no eta phase is present in the metallic interlayer of the article.

* * * * *